US011008788B2

(12) United States Patent
Brown et al.

(10) Patent No.: US 11,008,788 B2
(45) Date of Patent: May 18, 2021

(54) DOOR CLOSURE

(71) Applicant: Royal Wolf Trading Australia Pty Limited, New South Wales (AU)

(72) Inventors: Steven Brown, Queensland (AU); Brendon Greatrex, Queensland (AU); Ben Dupres, New South Wales (AU)

(73) Assignee: ROYAL WOLF TRADING AUSTRALIA PTY LIMITED

( * ) Notice: Subject to any disclaimer, the term of this patent is extended or adjusted under 35 U.S.C. 154(b) by 796 days.

(21) Appl. No.: 15/836,257

(22) Filed: Dec. 8, 2017

(65) Prior Publication Data

US 2018/0163441 A1 Jun. 14, 2018

(30) Foreign Application Priority Data

Dec. 9, 2016 (AU) ..... 2016102099

(51) Int. Cl.
*E05B 83/10* (2014.01)
*E05B 1/00* (2006.01)
(Continued)

(52) U.S. Cl.
CPC ..... *E05B 83/10* (2013.01); *B65D 90/008* (2013.01); *B65D 90/22* (2013.01); *B65D 90/54* (2013.01);
(Continued)

(58) Field of Classification Search
CPC ..... E05B 83/10; E05B 63/0069; E05B 67/38; E05B 13/002; E05B 13/001;
(Continued)

(56) References Cited

U.S. PATENT DOCUMENTS 2,672,041 A * 3/1954 Heyer ..... E05B 55/005 70/223
3,718,015 A * 2/1973 Tornoe ..... E05B 3/003 70/224
(Continued)

FOREIGN PATENT DOCUMENTS

| | | |
|---|---|---|
| EP | 2581528 A1 | 4/2013 |
| GB | 2154646 A | 9/1985 |
| KR | 100872687 B1 | 12/2008 |

OTHER PUBLICATIONS

Examination Report corresponding to Australian Patent Application No. 2016102099, dated May 18, 2018.
(Continued)

*Primary Examiner* — Kristina R Fulton
*Assistant Examiner* — Faria F Ahmad
(74) *Attorney, Agent, or Firm* — Tarolli, Sundheim, Covell & Tummino LLP

(57) ABSTRACT

Disclosed is a closure for a door of a shipping container. The closure includes a housing, an outside handle pivotally mounted relative to the housing, an inside handle pivotally mounted relative to the housing, and a catch connected to the inside handle. The closure is configured so that movement of the inside handle between a first position and a second position causes corresponding movement of the catch. A locking mechanism can releasably fix the inside handle relative to the outside handle, such that when in a locked position rotation of the outside handle causes corresponding rotation of the inside handle and when in an unlocked position the inside handle can be rotated independently of the outside handle.

19 Claims, 7 Drawing Sheets

(51) Int. Cl.

| | |
|---|---|
| ***B65D 90/54*** | (2006.01) |
| ***B65D 90/00*** | (2006.01) |
| ***E05B 83/08*** | (2014.01) |
| ***B65D 90/22*** | (2006.01) |
| ***E05B 63/00*** | (2006.01) |
| ***E05B 13/00*** | (2006.01) |
| ***E05C 9/04*** | (2006.01) |
| ***E05B 67/38*** | (2006.01) |
| ***E05B 55/06*** | (2006.01) |
| ***E05B 13/10*** | (2006.01) |
| ***E05B 85/12*** | (2014.01) |
| ***E05B 83/42*** | (2014.01) |
| ***E05B 85/10*** | (2014.01) |
| ***E05B 83/02*** | (2014.01) |
| ***E05B 85/22*** | (2014.01) |
| ***E05B 83/12*** | (2014.01) |
| ***E05C 7/00*** | (2006.01) |
| ***E05C 1/00*** | (2006.01) |
| ***E05B 65/00*** | (2006.01) |
| ***E05C 9/20*** | (2006.01) |
| ***E05B 79/22*** | (2014.01) |

(52) U.S. Cl.

CPC ..... *E05B 1/0053* (2013.01); *E05B 13/001* (2013.01); *E05B 13/002* (2013.01); *E05B 63/0065* (2013.01); *E05B 63/0069* (2013.01); *E05B 67/38* (2013.01); *E05B 83/08* (2013.01); *E05C 9/043* (2013.01); *B65D 2211/00* (2013.01); *B65D 2590/666* (2013.01); *E05B 13/004* (2013.01); *E05B 13/005* (2013.01); *E05B 13/101* (2013.01); *E05B 55/06* (2013.01); *E05B 65/0053* (2013.01); *E05B 79/22* (2013.01); *E05B 83/02* (2013.01); *E05B 83/42* (2013.01); *E05B 85/10* (2013.01); *E05B 85/12* (2013.01); *E05B 85/22* (2013.01); *E05C 1/004* (2013.01); *E05C 1/006* (2013.01); *E05C 7/00* (2013.01); *E05C 9/04* (2013.01); *E05C 9/20* (2013.01); *Y10S 292/21* (2013.01); *Y10T 292/0834* (2015.04); *Y10T 292/0836* (2015.04); *Y10T 292/0837* (2015.04); *Y10T 292/1047* (2015.04); *Y10T 292/57* (2015.04)

(58) Field of Classification Search

CPC .... E05B 63/0065; E05B 1/0053; E05B 13/10; E05B 47/0657; E05B 13/00; E05B 47/0676; E05B 55/06; E05B 85/10; E05B 85/12; E05B 83/02; E05B 83/12; E05B 83/42; E05B 85/22; E05B 79/22; E05B 77/32; E05B 83/08; E05B 65/0053; E05B 13/004; E05B 13/005; E05B 13/101; E05C 9/043; E05C 1/004; E05C 1/006; E05C 1/04; E05C 9/04; E05C 1/10; E05C 7/00; E05C 9/20; E05C 9/22; B65D 90/22; B65D 90/008; B65D 90/54; B65D 2211/00; B65D 2590/666; Y10T 292/0834; Y10T 292/0836; Y10T 292/0837; Y10T 292/57; Y10T 292/59; Y10T 292/546; Y10T 292/558; Y10T 292/564; Y10T 292/0969; Y10S 292/21; Y10S 292/31

See application file for complete search history.

(56) References Cited

U.S. PATENT DOCUMENTS 4,108,482 A * 8/1978 Dietrich ..... E05B 13/004 292/165
4,480,451 A * 11/1984 Fujiya ..... E05B 65/0053 292/21
4,487,440 A * 12/1984 Beijer ..... B64C 1/1407 292/336.3
4,510,779 A * 4/1985 Ahad ..... E05B 5/00 292/DIG. 31
4,581,907 A * 4/1986 Eberly ..... E05B 67/38 292/205
4,898,008 A * 2/1990 Eberly ..... E05B 67/38 292/DIG. 32
4,898,408 A * 2/1990 Hauber ..... E05B 63/0069 292/21
4,920,773 A * 5/1990 Surko, Jr. ..... E05B 55/06 70/224
5,004,278 A * 4/1991 Kang ..... E05B 55/005 292/169.18
5,590,555 A * 1/1997 Kester ..... E05B 17/2084 292/336.3
5,636,882 A * 6/1997 Hook ..... E05B 3/065 292/169.15
5,768,926 A * 6/1998 Shen ..... E05B 13/101 70/149
5,782,118 A * 7/1998 Chamberlain ..... E05B 47/0012 70/277
5,816,086 A * 10/1998 Russell, IV ..... E05B 13/101 70/422
5,904,232 A * 5/1999 Shen ..... E05B 13/101 192/69.62
6,065,314 A * 5/2000 Nicholson ..... E05B 67/383 292/218
6,490,895 B1 * 12/2002 Weinerman ..... E05B 5/00 292/166
6,508,087 B2 * 1/2003 Lemley ..... E05B 13/002 292/3
6,513,353 B1 * 2/2003 Weinerman ..... E05B 5/00 292/48
6,581,419 B1 * 6/2003 Strodtman ..... E05B 13/002 292/205
6,592,155 B1 * 7/2003 Lemley ..... E05B 67/38 292/33
6,742,367 B2 * 6/2004 Wu ..... E05B 13/101 292/336.3
6,869,116 B2 * 3/2005 Dalsing ..... E05B 3/065 292/336.3
6,928,843 B1 * 8/2005 Pirnie ..... E05B 67/38 292/205
6,971,689 B2 * 12/2005 Jackson ..... B64C 1/1407 292/163
7,048,312 B2 * 5/2006 Brunner ..... E05B 63/246 292/137
7,063,362 B1 * 6/2006 Liroff ..... G09F 3/0352 24/115 H
7,201,028 B1 * 4/2007 Gogel ..... E05B 67/38 292/205
7,210,316 B1 * 5/2007 Falconer ..... E05B 13/002 292/218
7,234,755 B1 * 6/2007 Senn ..... E05B 47/026 292/DIG. 32
7,412,856 B1 * 8/2008 Gogel ..... E05B 13/002 292/218
7,497,486 B1 * 3/2009 Davis ..... E05B 15/0205 292/169.14
7,845,201 B2 * 12/2010 Meyerle ..... G07C 9/00563 70/257
7,874,188 B2 * 1/2011 Chudzicki ..... E05B 83/12 70/56
8,011,217 B2 * 9/2011 Marschalek ..... E05B 47/0011 70/473
8,020,414 B2 * 9/2011 Pitisethakarn ..... E05C 19/186 70/14

(56) References Cited

U.S. PATENT DOCUMENTS

| | | | | |
|---|---|---|---|---|
| 8,539,802 | B2 * | 9/2013 | Meyerle | E05B 47/068 70/257 |
| 9,982,455 | B2 * | 5/2018 | Badhya | E05B 55/005 |
| 10,533,354 | B2 * | 1/2020 | Phillips | E05B 85/103 |
| 2006/0012188 | A1 * | 1/2006 | Gogel | E05B 13/001 292/336.3 |
| 2006/0290147 | A1 * | 12/2006 | Liroff | G09F 3/0352 292/327 |
| 2007/0029820 | A1 * | 2/2007 | Navarsky | G09F 3/0358 292/315 |
| 2007/0096473 | A1 * | 5/2007 | Ortega | E05B 1/0053 292/1 |
| 2007/0262588 | A1 * | 11/2007 | Lemley | E05B 67/38 292/36 |
| 2011/0083480 | A1 * | 4/2011 | Linger | F16P 3/08 70/77 |
| 2012/0103032 | A1 * | 5/2012 | Thomsen | E05B 67/383 70/14 |
| 2012/0210754 | A1 * | 8/2012 | Thomsen | E05B 83/10 70/14 |
| 2012/0267903 | A1 * | 10/2012 | Welsby | E05B 55/005 292/145 |
| 2014/0191516 | A1 * | 7/2014 | Badhya | E05B 13/004 292/145 |
| 2015/0337560 | A1 * | 11/2015 | Linares | E05B 13/002 292/336.3 |
| 2016/0177604 | A1 * | 6/2016 | Ring | B61D 39/006 292/188 |
| 2020/0207453 | A1 * | 7/2020 | di Tota | E05B 13/002 |

OTHER PUBLICATIONS

Lockwood Code Handle Keyless Lockset [retrieved from internet on May 18, 2018]<URL: http://web.archive.org/web/20140520193619/http://www.lockweb.com.au:80/en/site/lockweb/Lockwood-Products/?productId=1189542 > published on May 20, 2014 as per Wayback Machine.

Shipping Container Doors [retrieved from internet on May 18, 2018]<URL: http://web.archive.org/web/20160416164350/http://www.budgetshippingcontainers.ca.uk/sales/shipping-container-doors/ > published on Apr. 16, 2014 as per Wayback Machine.

Shipping Container Accessories [retrieved from internet on May 8, 2018] https://web.archive.org/web/20160306065257 /https://portshippingcontainers.com.au/container-accessories.html > published on Mar. 6, 2014 as per Wayback Machine.

Examination Report No. 1 for innovation patent for corresponding Australian application No. 2016102099, dated Jan. 31, 2018.

* cited by examiner

SECTION C-C

DOOR CLOSURE

RELATED APPLICATIONS

The present invention is a U.S. patent application, claiming priority to Australian Patent Application No. 2016102099, filed on 9 Dec. 2016, the entirety of which is incorporated herein by reference.

TECHNICAL FIELD

The present invention generally relates to door closures, such as, but not limited to, a door closure for a shipping container.

BACKGROUND

Intermodal freight containers, commonly known as shipping containers, are commonly configured with two doors at one end, hingedly attached at the sides of the container and opening outwardly. They are typically held closed by two locking bars on each door. These locking bars extend vertically along the outside of the doors and couple with cams above and below the door. The coupling of the locking bars with the cams can assist with compressing a seal surrounding the doors and holding the door in the closed position.

Locking bars have a number of disadvantages, particularly in the case of repurposed shipping containers. These disadvantages include being difficult to operate, particularly when seals are very new or have started to deteriorate. Locking bars also fail to allow for escape from within the container in the event that a person is inadvertently locked inside.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

SUMMARY

According to one aspect, there is provided a closure for a door of a shipping container, including: a housing; an outside handle pivotally mounted relative to the housing; an inside handle pivotally mounted relative to the housing; a catch connected to the inside handle such that movement of the inside handle between a first position and a second position causes corresponding movement of the catch; and a locking mechanism configured to releasably fix the inside handle relative to the outside handle, such that: when the locking mechanism is in a locked position rotation of the outside handle causes corresponding rotation of the inside handle; and when the locking mechanism is in an unlocked position the inside handle can be rotated independently of the outside handle.

In a particular, but non-limiting, example form, the closure further includes: an upper link rod pivotally connected to the inside handle and connected to an upper strike rod; and a lower link rod pivotally connected to the inside handle and connected to a lower strike rod, wherein when the catch is in the first position: the catch extends beyond the edge of a door to which it is mounted; the upper strike rod extends beyond an upper edge of the door; and the lower strike rod extends beyond a lower edge of the door, and wherein when the catch is in the second position, each of the catch, upper strike rod and lower strike rod are retracted so that they do not extend beyond the respective edges of the door.

In one form, when the catch is in the first position, the catch abuts an inside surface of a strike plate that is adjustably fitted to an adjacent door of the shipping container. In another form, the inside handle and the catch are a single component.

In another form, the inside handle and outside handle are connected by a shaft, the shaft being fixed to the outside handle and free to rotate relative to the inside handle when the locking mechanism is in an unlocked position. In yet another form, the shaft includes a flange projecting substantially normal to an axis of the shaft and the locking mechanism includes a pin that, when in the locked position, extends through the inside handle and the flange, thereby stopping the inside handle from rotating relative to the shaft when in the locked position.

In other particular, but non-limiting, example forms: the pin is in the form of a plunger that is biased towards the locked position; the flange is configured to be releasably locked so that when it is locked it cannot rotate relative to the housing; the flange is locked by a lock that is located substantially inside the door to which the closure is mounted; and the lock is replaceable.

In still further particular, but non-limiting, example forms: the outside handle is configured to be releasably locked so that when it is locked it cannot rotate relative to the housing; the outside handle is locked to the housing by a padlock that connects a tab of the handle to a bracket of the housing; and the housing substantially encloses the padlock when fitted, other than an opening to install and remove the padlock.

Advantageously, the ability to release the locking mechanism can allow a person inside the shipping container to escape, even if the outside handle is locked in position. If the locking mechanism is only accessible from the inside of the shipping container, however, this allows the escape of a person inside the shipping container without compromising security of the container.

According to another aspect, there is provided a method of fitting a closure to a shipping container, the closure being substantially as herein defined, the method including the steps of: fitting an internal portion of the closure to the inside of a door of the shipping container when the door is in a closed position; thereafter removing locking bars from the outside of the door to which the closure is being fitted; and fitting an external portion of the closure to the outside of the door.

In one form, the method further includes the step of replacing a door seal prior to fitting the internal portion of the closure. In yet another form, the method further includes the step of fitting a strike plate to an adjacent door of the shipping container.

According to another aspect, there is provided a shipping container including a closure substantially as herein described. The closure may be retrofitted to the shipping container or fitted during manufacture.

BRIEF DESCRIPTION OF FIGURES

Example embodiments should become apparent from the following description, which is given by way of example only, of at least one preferred but non-limiting embodiment, described in connection with the accompanying figures, wherein.

DETAILED DESCRIPTION

Figures 1, 2:
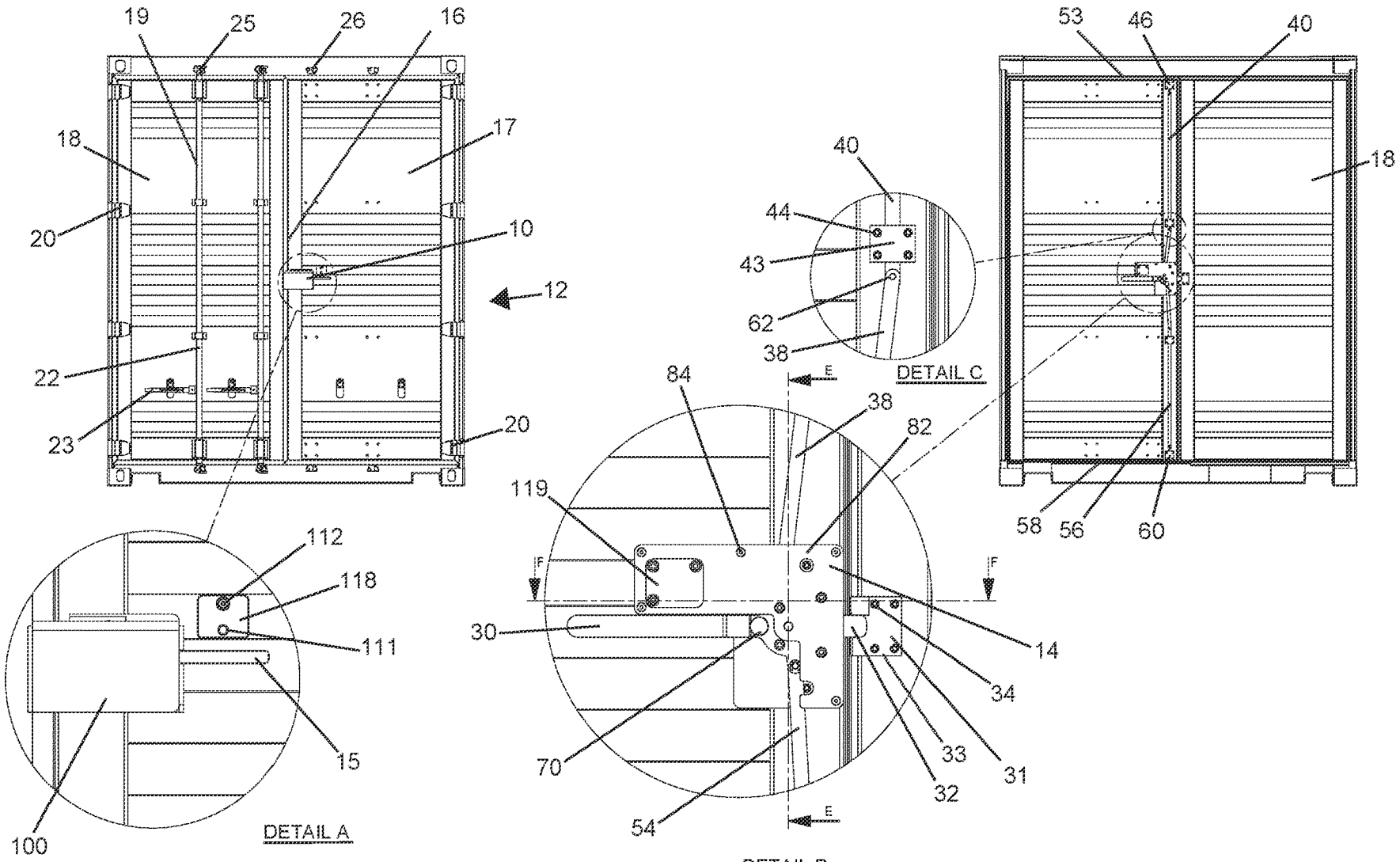
FIG. 1 illustrates a front elevation view of a shipping container door with a closure according to the present invention, along with an enlarged view (Detail A) of the closure.
FIG. 2 illustrates a rear elevation view of the shipping container door (viewed from inside the shipping container) with the closure fitted, along with an enlarged view of the closure (Detail B) and a striker assembly (Detail C)

The following modes, given by way of example only, are described in order to provide a more precise understanding of the subject matter of a preferred embodiment or embodiments.

In the Figures, incorporated to illustrate features of an example embodiment, like reference numerals are used to identify like parts throughout the Figures.

Referring to FIG. 1, a closure 10 for a shipping container 12 is shown as viewed from the outside of the shipping container 12. The closure 10 includes an outside housing 100, from which protrudes an outside handle 15. The closure 10 is fixed to a first door 17 of the shipping container 12 and partially protrudes past an edge 16 of the first door 17 so that it extends over a second door 18 when the doors are in a closed position as shown.

The second door 18 uses standard components for being held in a closed position as are known in the art and commonly used on shipping containers. These are generally known as locking bars 19. The second door 18 is attached to the wall of the container 12 by hinges 20 along the outer edge, as is also the case for the first door 17. The doors are permitted to open outwardly, but prevented from moving inwardly by seals which the doors contact when in the closed position.

The closure used for the second door 18 includes vertical rods 22, each with a handle 23 to aid rotation of the rods 22. The ends of the rods 22 include couplers that cooperate with cams, or retainers 25, fixed to the outside of the container 12 above and below the door opening.

When the door is brought towards the closed position, the couplers enter the retainers 25, but the seals stop the door 18 from closing completely. Rotation of the rods 22 by the handles 23 causes the door 18 to be pulled inwardly by the couplers in combination with the retainers 25, thereby compressing the seal as the door 18 is completely closed.

Retainers 26 remain above and below the first door 17 as well, however the rods and other components have been removed. The closure 10 that is fitted to the first door 17 can use the second door 18 to help hold the door 17 closed. That is, the second door 18 will typically be closed and locked first, with the closure 10 coupling the first door 17 to the second door 18, as will be described in more detail below.

FIG. 2 shows the closure 10 as it can be seen from the inside of the shipping container 12. The internal portion of the closure 10 includes an inside housing 14 with an inside handle 30 protruding out one side and a catch 32 protruding out the opposite side. When in the closed position as shown, the catch 32 contacts an inner surface 31 of a strike plate 33 that is fixed to the second door 18. The strike plate 33 is held in place by screws 34. In this way, the catch 32 prevents the first door 17 from being opened, provided the second door 18 is locked in the closed position.

Figure 3:
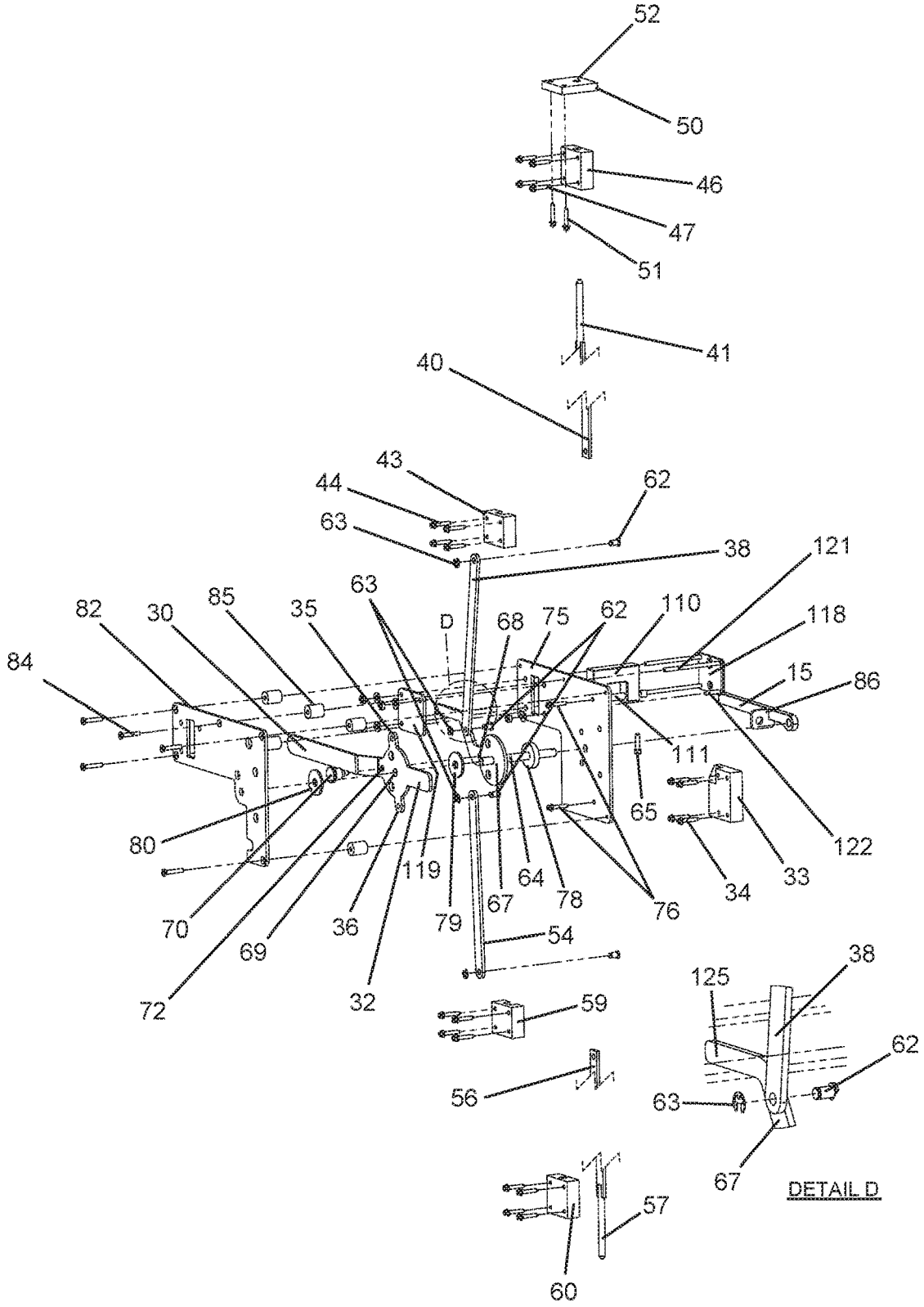
FIG. 3 illustrates an isometric exploded view of the closure, along with an enlarged view of the upper link rod and part of the flange (Detail D)

Referring to FIG. 3, the inner workings of the internal portion of the closure 10 are shown in more detail. It can be seen that the inside handle 30 is a single piece with the catch 32, and this piece also includes an upper protrusion 35 and a lower protrusion 36. In alternative embodiments, however, the catch 32 may be a separate component that is operatively coupled to the inside handle 30.

The upper protrusion 35 connects to an upper link rod 38, which in turn is connected to an upper strike rod 40 that includes an upper pin 41. The upper strike rod 40 is guided by a top inner rod guide 43 which is held in place by screws 44 and a top outer rod guide 46 which is held in place by screws 47.

A top receiving plate 50 is fitted to the shipping container above an upper edge 53 of the first door 17 by screws 51. The top receiving plate 50 includes a hole 52 sized to receive the upper pin 41. The rod guides 43, 46 ensure that the upper strike rod 40 moves in a linear manner, ensuring smooth operation of the upper pin 41 entering the top receiving plate 50.

A similar setup of components is also located to the lower side of the housing 14. That is, the lower protrusion 36 connects to a lower link rod 54, which in turn is connected to a lower strike rod 56 that includes a lower pin 57. The lower strike rod 56 is guided by a bottom inner rod guide 59 and a bottom outer rod guide 60. A bottom receiving plate (not shown) is fitted to the shipping container 12 below a lower edge 58 of the first door 17. The bottom receiving plate includes a hole sized to receive the lower pin 57, in a similar manner to the upper receiving plate 50.

Each of the connections between the inside handle 30, link rods 38, 54 and strike rods 40, 56 uses a pin 62 and circlip 63. It will be appreciated, however, that alternative forms of fasteners can be used and are considered to fall within the scope of the invention, provided they allow the required relative rotation of the connected components.

When the door 17 is locked in the closed position, the upper pin 41 and lower pin 57 are located in the holes of the upper receiving plate 50 and lower receiving plate respectively. The catch 32 is also located behind the striking plate 33, so that there are three points of contact holding the first door 17 closed, both to the shipping container 12 body and to the second door 18.

When the inner handle 30 is rotated to an unlocked position, the catch 32 is thereby rotated to a position where it is substantially or completely behind the first door 17. Simultaneously, rotation of the inner handle 30 causes the upper pin 41 and lower pin 57 to also be withdrawn to a position behind the first door 17, due to the connection to the inner handle 30 by the upper link rod 38 and lower link rod 54. Therefore, rotation of the inner handle 30 causes all three locking points to be released, allowing the first door 17 to be opened.

The inner handle 30 and the outer handle 15 are operatively connected to one another by a shaft 64. The outer handle 15 is fixed to the shaft 64 by a pin 65 that extends through both components, such that the outer handle 15 cannot rotate independently of the shaft 64.

The shaft 64 includes a flange 67 with a hole 68. The inner handle 30 is placed onto the shaft 64, with the shaft 64 protruding through a central hole 69 of the inner handle 30. In some configurations, this leaves the inner handle 30 free to rotate relative to the shaft 64.

The inner handle 30 may be locked to the shaft 64, however, by inserting a plunger 70 through both a locking hole 72 of the inner handle 30 and the hole 68 of the flange 67. This prevents the inner handle 30 rotating relative to the shaft 64, and thereby also preventing relative rotation of the inner handle 30 relative to the outer handle 15.

Some remaining components illustrated in FIG. 3 are used for packaging and assembly of the closure 10. For example, a backing plate 75 forms part of the housing 14 and is secured to the first door 17 using screws 76. The flange 67 is separated from the backing plate 75 when assembled by a spacer 78. A washer 79 fits over the shaft 64 to separate the flange 67 from the inner handle 30 and another washer 80 separates the inner handle 30 from a front plate 82 of the housing 14. The housing 14 is held together using screws 84 that connect the front plate 82 to the backing plate 75, with spacers 85 ensuring the correct separation between the front plate 82 and the backing plate 75.

Figure 4C:
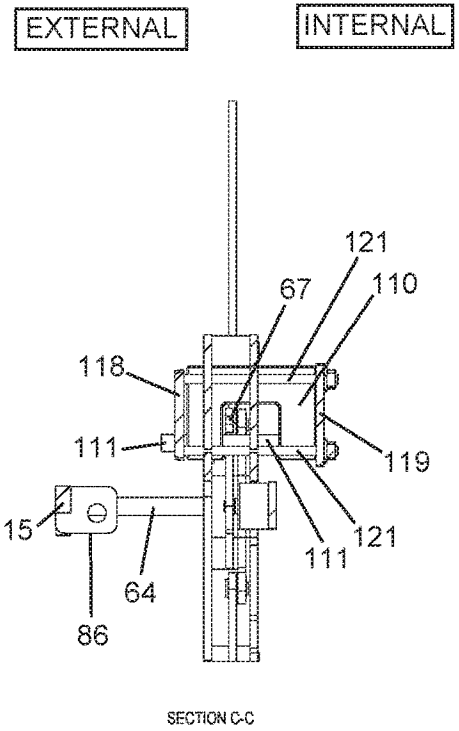
FIG. 4C illustrates a cross sectional elevation view (Section C-C from FIG. 4A) of the closure with the outside housing removed.
Figure 4B:
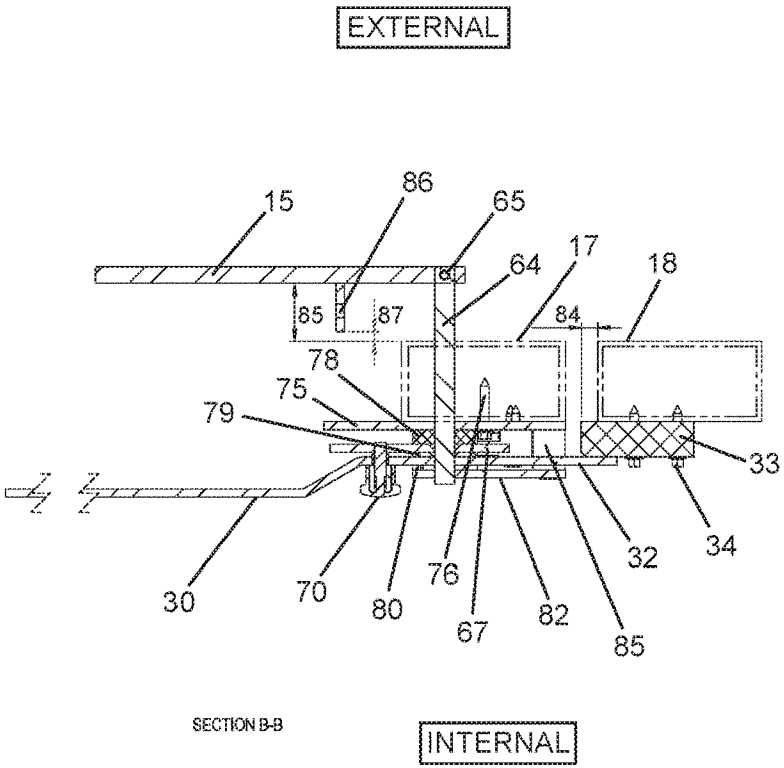
FIG. 4B illustrates a cross sectional plan view (Section B-B from FIG. 4A) of the closure with an outside housing removed.
Figure 4A:
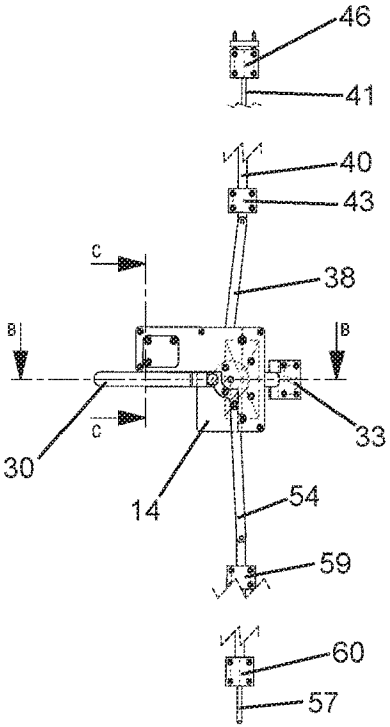
FIG. 4A illustrates a rear elevation view of the closure.
Figure 6:
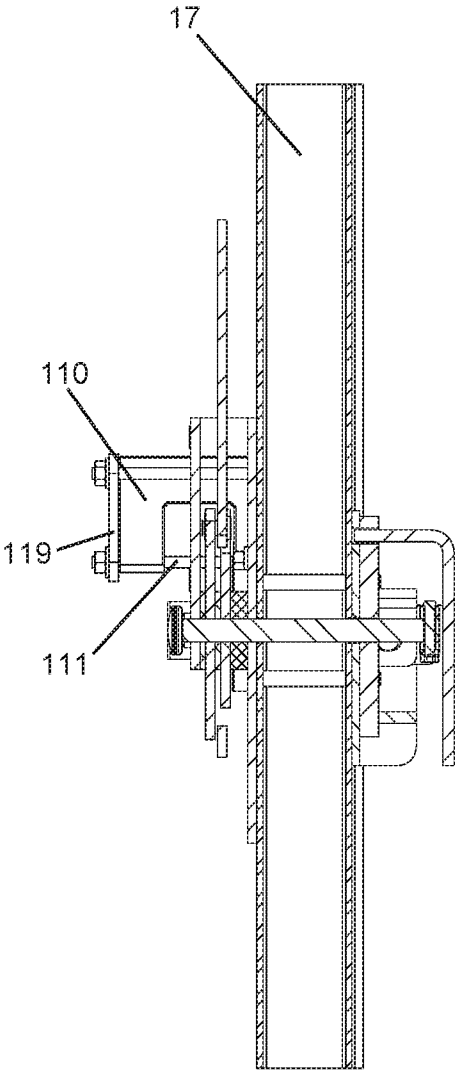
FIG. 6 illustrates a cross sectional elevation view (Section E-E from FIG. 2) of the closure.

FIGS. 4A, 4B and 4C show the layout of the internal portion of the closure 10 in more detail. FIG. 4B shows that there is an overlap 84 of the strike plate 33 relative to the edge of the second door 18. This figure also shows that the outside handle 15 extends a distance 85 away from the outside surface of the first door 17, the reasons for which will be described in more detail below. The locking tab 86, however, extends from the outside handle 15 back towards the first door 17 so that it is spaced from the door by a much smaller distance 87.

Figure 5:
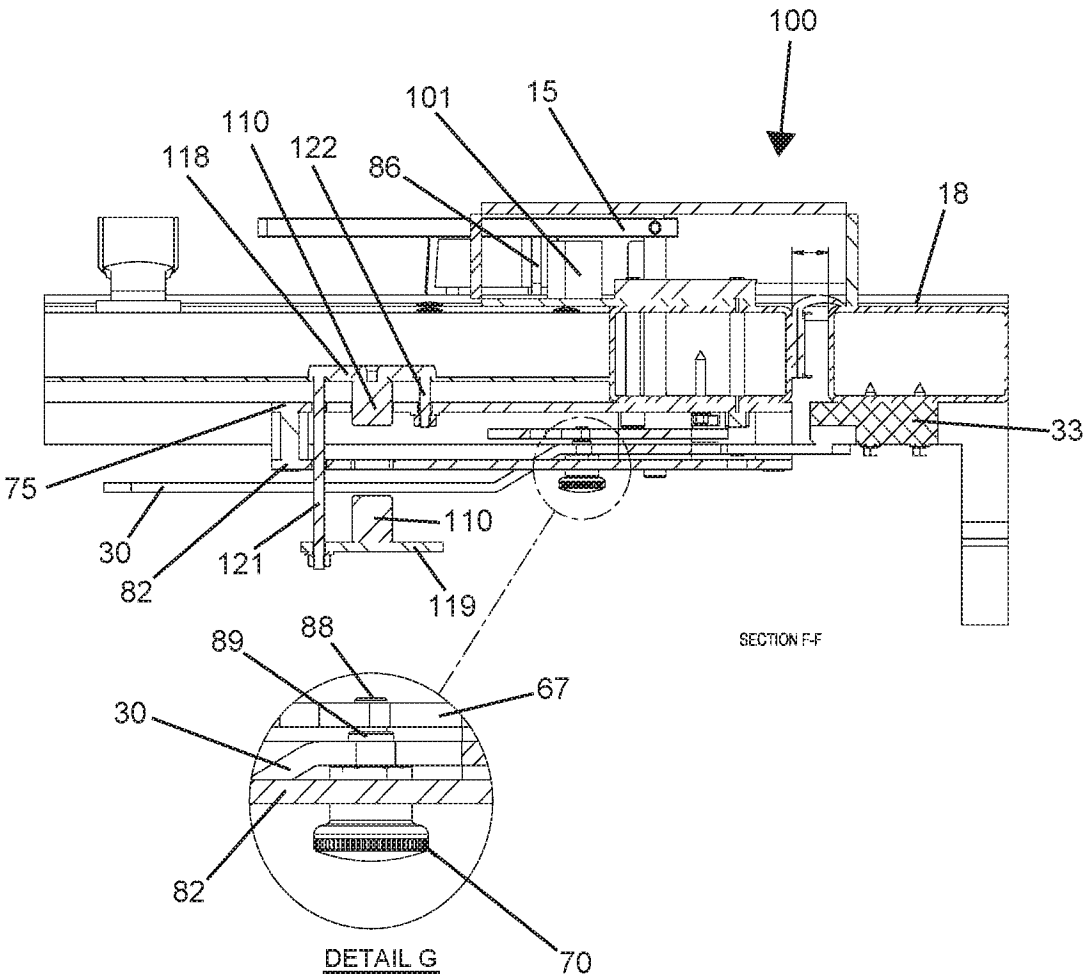
FIG. 5 illustrates a cross sectional plan view (Section F-F from FIG. 2) of the closure, along with an enlarged view of an internal release (Detail G)
Figure 8:
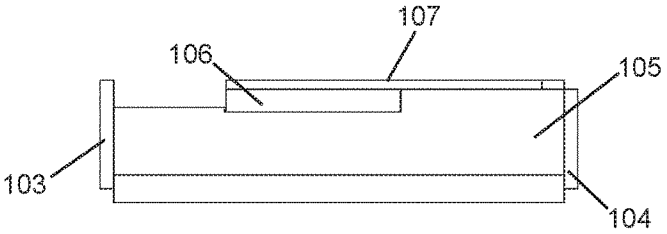
FIG. 8 illustrates a plan view of the outside housing.
Figure 10:
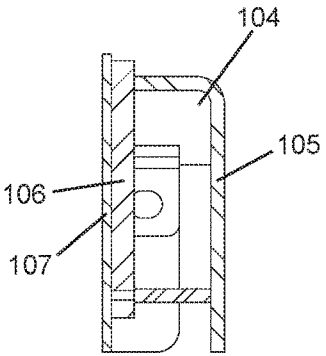
FIG. 10 illustrates a cross sectional side elevation view (Section C-C from FIG. 9) of the outside housing.
Figure 7:
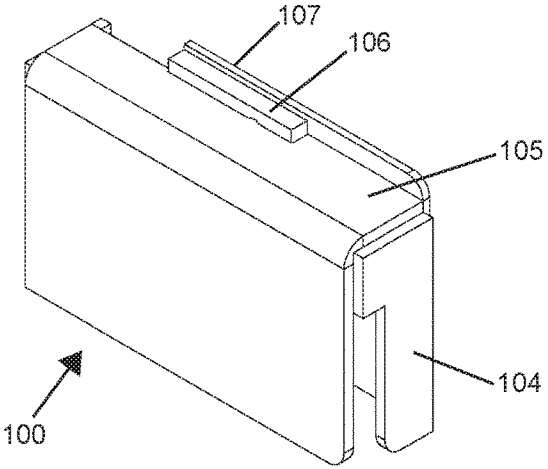
FIG. 7 illustrates an isometric view of the outside housing.
Figure 9:
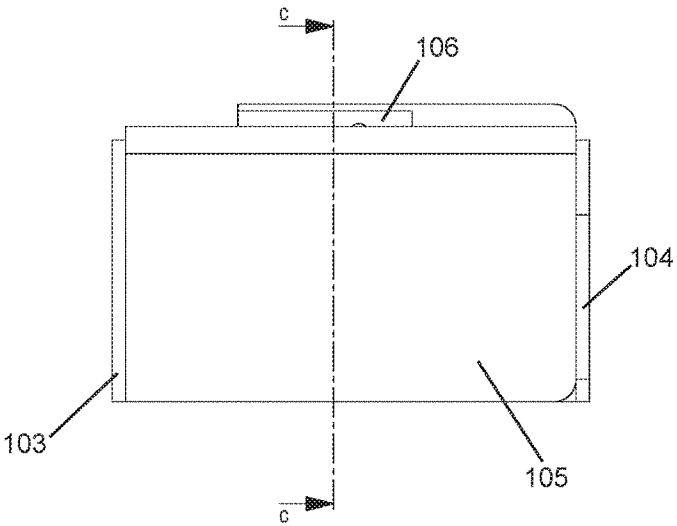
FIG. 9 illustrates a front elevation view of the outside housing.

Referring now to FIG. 5, the plunger 70 is shown in more detail (see Detail G). The plunger 70 includes a pin component 88 and a mounting component 89, with a biasing member (not shown) coupled between the two, such that the pin component 88 is biased towards the extended or locked position as shown.

In the locked position, the pin component 88 extends through the hole 68 (see FIG. 3) of the flange 67, thereby causing the inside handle 30 and flange 67, and ultimately the outside handle 15, to be rotatably locked to one another. Therefore, rotation of the outside handle 15 causes corresponding rotation of the inside handle 30, thereby allowing the door 17 to be opened from outside the shipping container 12.

The force from the biasing member in the plunger 70 can be overcome by pulling on the outside of the large portion of the plunger 70, as it is directly connected to the pin component 88. The biasing member causes the pin component 88 to return to the locked position when this pulling force is released, assuming it is aligned with the hole 68.

When the pin component 88 is retracted, the inside handle 30 is no longer rotatably locked to the flange 67, and therefore also no longer rotatably locked to the outside handle 15. Therefore, by withdrawing the pin component 88 in this way, the inside handle 30 can be rotated independently of the outside handle 15.

The advantage of allowing the inside handle 30 to be rotated independently in some circumstances is that it allows a person inside the shipping container 12 to be able to release themselves from the shipping container 12 even if the outside handle 15 and/or flange 67 are locked in position. As the plunger 70 is located inside the shipping container 12, however, the security is not compromised as it can only be accessed from within the shipping container 12.

FIG. 5 also shows the external portion of the closure 10, which can be used to lock the outside handle 15 in the closed position. The external portion includes an outside housing 100, inside which is a locking bracket 101 that can be locked to the locking tab 86. The outside housing 100 is shown in more detail in FIG. 12, where a hole 102 in the locking bracket 101 can be seen, allowing a padlock or similar device to secure the locking bracket 101 to the locking tab 86.

Figure 11A:
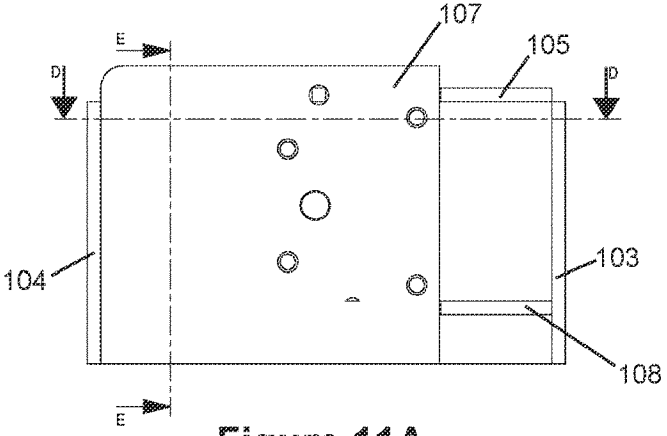
FIG. 11A illustrates a rear elevation view of the outside housing.
Figure 11B:
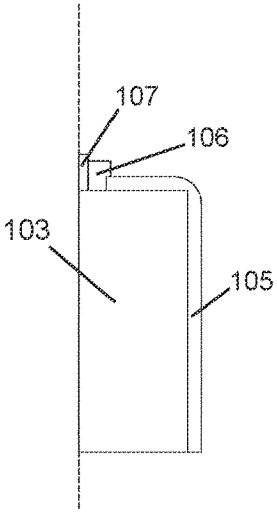
FIG. 11B illustrates a side elevation view of the outside housing.
Figure 11C:
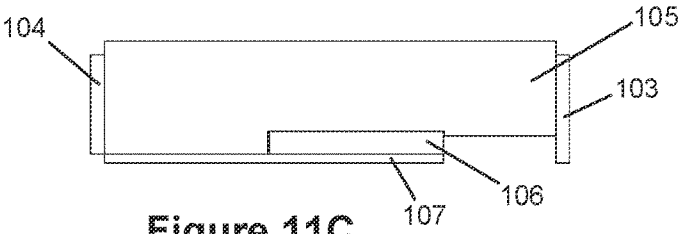
FIG. 11C illustrates a plan view of the outside housing.
Figure 11D:
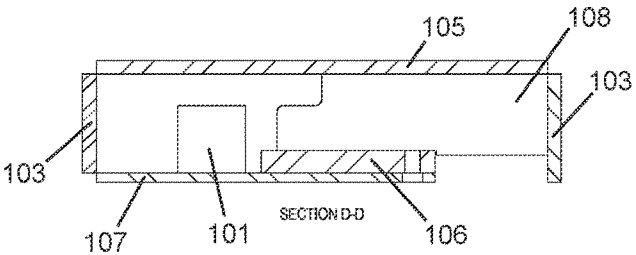
FIG. 11D illustrates a cross sectional plan view (Section D-D from FIG. 11A) of the outside housing.
Figure 11G:
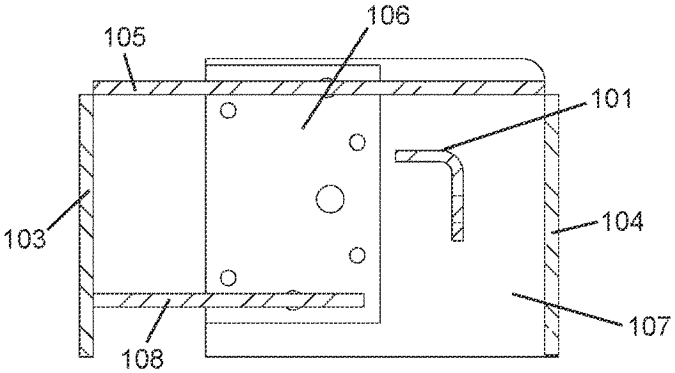
FIG. 11G illustrates a cross sectional front elevation view (Section F-F from FIG. 11F) of the outside housing.
Figures 11E, 11F:
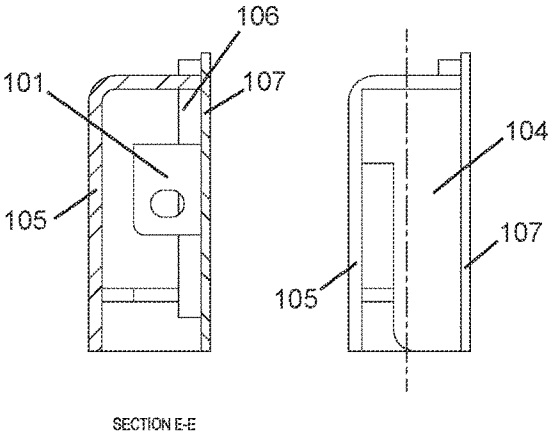
FIG. 11E illustrates a cross sectional side elevation view (Section E-E from FIG. 11A) of the outside housing.
FIG. 11F illustrates a side elevation view of the outside housing.
Figure 12:
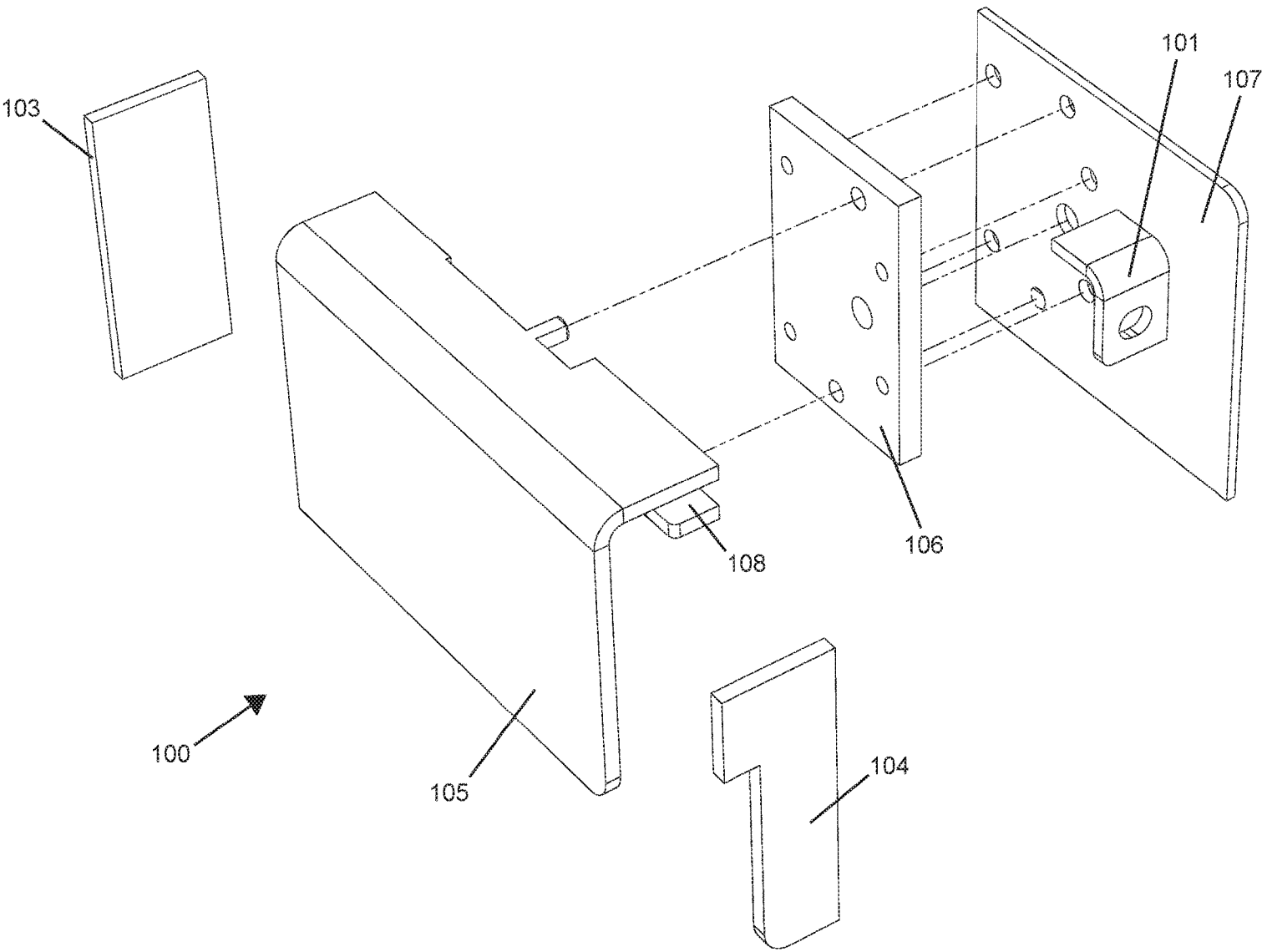
FIG. 12 illustrates an isometric exploded view of the outside housing.

FIG. 12 also shows the outside housing 100 being made up of a first end plate 103, a second end plate 104, an outer cover 105, a baseplate 106, a bracket 107 and a bottom cover 108 (better shown in FIG. 11G, for example). When assembled, this results in the outside housing 100 substantially enclosing the locking bracket 101 and the portion of the outside handle 15 that includes the locking tab 86. Just a small opening is provided for the outside handle 15 to extend past the second end plate 104 and an opening at the bottom of the housing 100 to provide access to the locking bracket 101 and tab 86.

Preferably a padlock is used to releasably lock the bracket 101 to the tab 86. Such a padlock can be installed and removed via the small opening that is provided at the bottom of the housing 100. As the housing 100 largely encloses the padlock, however, this makes it much more difficult for the padlock to be forcibly broken and removed.

Referring to FIG. 3, the closure 10 further includes a lock 110 in addition to the mechanism for securing the outside handle 15 as described above. The lock 110, however, secures the flange 67, rather than the outside handle 15. The lock 110 is C-shaped with a lock pin 111 that removably extends across the opening of the lock 110. The lock pin 111 can be secured in the lock position and released using a key via the keyhole 112 (see FIG. 1).

The lock 110 is preferably replaceable, being installed through an opening 114 in the backing plate 75 and an opening 115 in the front plate 82. A front lock plate 118 abuts the external side of the lock 110 when installed and a back lock plate 119 abuts the internal side. Long fasteners 121 secure the front lock plate 118 and back lock plate 119 to each other, while a shorter fastener 122 secures the front lock plate 118 to the backing plate 75.

The lock 110 is positioned so that when the inside handle 30 is in the closed position, an extension 125 of the flange 67 is positioned between the arms of the lock 110. The lock pin 111 can then be inserted so that is extends across the lock 110 below the extension 125, thereby preventing rotation of the flange 67. To rotate the flange 67, the lock 110 must be released and the lock pin 111 withdrawn, thereby allowing the extension 125 to be moved in a downward direction out of the space between the arms of the lock 110.

As the flange 67 is rotationally fixed to the outside handle 15, this second locking means has the same effect of preventing movement of the outside handle. It still allows movement of the inside handle, however, if the plunger 70 is withdrawn as described above. Therefore, opening the closure from the inside is still possible when the lock pin 111 is in position and the flange 67 is prevented from rotating.

It will be appreciated that the closure can be locked by using either (or both) of the locking means described. It will also be appreciated that alternative embodiments may optionally only include one or the other of the locking means described. However, using both of the locking means may allow for added security due to the need for both to be broken in order to forcefully open the closure from the outside.

The lock 110 being located substantially on the inside of the panel to which the closure 10 is mounted is advantageous, as it reduces the possibility of tampering or forcefully opening the lock 110 from outside.

FIGS. 7 to 11G show various views of the outside housing 100. The outer cover 105 is formed by folding plate steel into shape and welding along the necessary edges with the adjacent components, such as the end plates 103, 104 and the bottom cover 108.

As shown in FIG. 11G, for example, the outside housing 100 only allows a small opening on the bottom through which the locking bracket 101 can be accessed, thereby ensuring the outside housing 100 is a resistant to tampering or forced entry as possible, such as by applying an impact force to a padlock connecting the locking bracket 101 to the locking tab 86.

As described above, however, even when the outside handle 15 is held in place by the locking tab 86 (or the lock 110 via the flange 67), the first door 17 can still be released from inside the shipping container 12 by withdrawing the plunger 70 and rotating the inside handle 30 independently of the outside handle 15.

The closure 10 described above may be retrofitted to the shipping container 12. The shipping container 12 may be new or used, and would by of a standard form, such as the high cube container shown in FIGS. 1 and 2. It could be shipped to a desired location with all standard components in place, including the locking bars on both doors, for example. Once in location the closure 10 could then be fitted.

The method of fitting the closure 10 includes first deciding on a desired position, which may include using the locking rods to correctly position the seal. Once the inside housing 14 and outside housing 100 are correctly positioned, the locking rods may then be removed. Alternatively, the outside housing 100 may be fitted at a later stage.

The upper strike rod 40 and lower strike rod 56 are cut to length and drilled only after the inside housing 14 is already fitted. The strike plate 33 is also fitted after the inside housing 14 so that it can be adjusted to suit and ensure correct closing positioning relative to the catch 32.

Retrofitting the closure 10 is advantageous because the shipping container 12 may not conform to some ISO standards once it is fitted, particularly after the outside housing 100 is fitted. However, alternative embodiments of the closure 10 are envisioned that have a lower profile to allow the shipping container 12 to remain ISO compliant with the closure 10 fitted.

Further alternative embodiments may be fitted during manufacture of the shipping container 12, rather than retrofitted. This allows them to be built into the door so that they do not protrude to the extent of the embodiment described above, also allowing the shipping container 12 to remain ISO compliant.

Due to the requirement to compress the seal surrounding the door 17, the seal may optionally be removed or replaced to enable easier opening and closing of the door 17. Because the closure 10 does not pull the door 17 towards the closed position, the original seal may make it difficult to close the door 17 far enough to allow the closure 10 to be moved to the closed position. Therefore, replacing the seal with an alternative seal made of softer material or with a different profile, for example, may allow the door 17 to be easily closed even once the closure 10 is fitted, while preferably still retaining the required sealing properties against water and other environmental factors.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above" and "below" and the like are used as words of convenience to provide reference points and are not to be construed as limiting terms.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

Whilst the present invention has been described with reference to particular embodiments, it will be understood that many modifications will be apparent to those skilled in the art. All such variations and modifications should be considered to fall within the scope of the invention as broadly described and as claimed below.

The invention claimed is:

1. A closure for a door of a shipping container, comprising:

a housing;

an outside handle pivotally mounted relative to the housing;

an inside handle pivotally mounted relative to the housing;

a catch connected to the inside handle such that movement of the inside handle between a first position and a second position causes corresponding movement of the catch;

an upper link rod connected to an upper strike rod and a lower link rod connected to a lower strike rod, each of the link rods pivotally connected to the inside handle, wherein when the inside handle is in the first position the catch extends beyond an edge of a door to which it is mounted, the upper strike rod extends beyond an upper edge of the door, and the lower strike rod extends beyond a lower edge of the door, and when the inside handle is in the second position, each of the catch, upper strike rod and lower strike rod are retracted so that they do not extend beyond the respective edges of the door; and a locking mechanism configured to releasably fix the inside handle relative to the outside handle, wherein when the locking mechanism is in a locked position rotation of the outside handle causes corresponding rotation of the inside handle, and wherein when the locking mechanism is in an unlocked position the inside handle can be rotated independently of the outside handle.

2. The closure according to claim 1, wherein when the catch is in the first position, the catch abuts an inside surface of a strike plate that is adjustably fitted to an adjacent door of the shipping container.

3. The closure according to claim 1, wherein the inside handle and the catch are a single component.

4. The closure according to claim 1, wherein the inside handle and outside handle are connected by a shaft, the shaft being fixed to the outside handle and free to rotate relative to the inside handle when the locking mechanism is in an unlocked position.

5. The closure according to claim 4, wherein the shaft comprises a flange projecting substantially normal to an axis of the shaft and the locking mechanism comprises a pin that, when in the locked position, extends through the inside handle and the flange, thereby stopping the inside handle from rotating relative to the shaft when in the locked position.

6. The closure according to claim 5, wherein the pin is in the form of a plunger that is biased towards the locked position.

7. The closure according to any one of claim 5, wherein the flange is configured to be releasably locked so that when it is locked it cannot rotate relative to the housing.

8. The closure according to claim 7, wherein the flange is locked by a lock that is located substantially inside the door to which the closure is mounted.

9. The closure according to claim 8, wherein the lock is replaceable.

10. The closure according to claim 1, wherein the outside handle is configured to be releasably locked so that when it is locked it cannot rotate relative to the housing.

11. The closure according to claim 10, wherein the outside handle is locked to the housing by a padlock that connects a tab of the handle to a bracket of the housing.

12. The closure according to claim 11, wherein the housing substantially encloses the padlock when fitted, other than an opening to install and remove the padlock.

13. The closure according to claim 7, wherein the outside handle is also configured to be releasably locked so that when it is locked it cannot rotate relative to the housing.

14. The closure according to claim 13, wherein the flange is locked by a lock that is located substantially inside the door to which the closure is mounted.

15. The closure according to claim 1, wherein the closure is configured to be retrofitted to a shipping container.

16. A method of fitting a closure to a shipping container, the closure being defined according to claim 1, the method comprising the steps of:

fitting an internal portion of the closure to the inside of a door of the shipping container when the door is in a closed position;

thereafter removing locking bars from the outside of the door to which the closure is being fitted; and fitting an external portion of the closure to the outside of the door.

17. The method according to claim 16, further comprising the step of replacing a door seal prior to fitting the internal portion of the closure.

18. The method according to claim 16, further comprising the step of fitting a strike plate to an adjacent door of the shipping container.

19. A shipping container comprising a closure according to claim 1.

* * * * *